US005924468A

United States Patent [19]

Bisconti

[11] Patent Number: 5,924,468

[45] Date of Patent: Jul. 20, 1999

[54] RETRACTABLE WINDOW PROTECTION DEVICE

[76] Inventor: Vincent Bisconti, 25 Lindner Pl., Malverne, N.Y. 11562

[21] Appl. No.: 09/024,524

[22] Filed: Feb. 17, 1998

[51] Int. Cl.[6] ..... E05D 15/26

[52] U.S. Cl. ..... 160/183; 160/35; 160/117

[58] Field of Search ..... 160/183, 199, 160/117, 118, 119, 172 V, 172 R, 206, 84.06, 84.01, 233, 19, 32, 35

[56] References Cited

U.S. PATENT DOCUMENTS

| | | | |
|---|---|---|---|
| 2,042,354 | 5/1936 | Munson | 160/35 |
| 2,299,095 | 10/1942 | Knox | 160/172 R |
| 2,523,392 | 9/1950 | Rabinowitz et al. | 160/172 R |
| 3,020,951 | 2/1962 | Graulich | 160/35 |
| 3,516,470 | 6/1970 | Kurz | 160/35 |
| 3,853,169 | 12/1974 | Music et al. | 160/118 X |
| 4,431,044 | 2/1984 | Bruneau | 160/117 |
| 4,799,528 | 1/1989 | Benitez | 160/206 X |
| 5,099,904 | 3/1992 | Susnar | 160/199 |
| 5,316,065 | 5/1994 | Alligood | 160/172 R X |
| 5,458,179 | 10/1995 | Magaldi et al. | 160/199 X |
| 5,522,445 | 6/1996 | Hoffman | 160/206 X |
| 5,620,037 | 4/1997 | Apostolo | 160/118 |

*Primary Examiner*—David M. Purol
*Attorney, Agent, or Firm*—Darby & Darby

[57] ABSTRACT

A retractable window protection device is disclosed that can be extended to cover a window when needed, for example during a severe storm with high winds. The retractable window protection device incorporates at least one housing mounted to the building adjacent the window. A shutter assembly is housed in the housing and includes plural panel members that are extendable out of the housing to cover the window. An engagement device is also provided and is displaceable between disengaged and engaged positions. The engagement device includes an engagement surface that complements the configuration of the panel members when extended from the housing.

16 Claims, 4 Drawing Sheets

FIG. 2
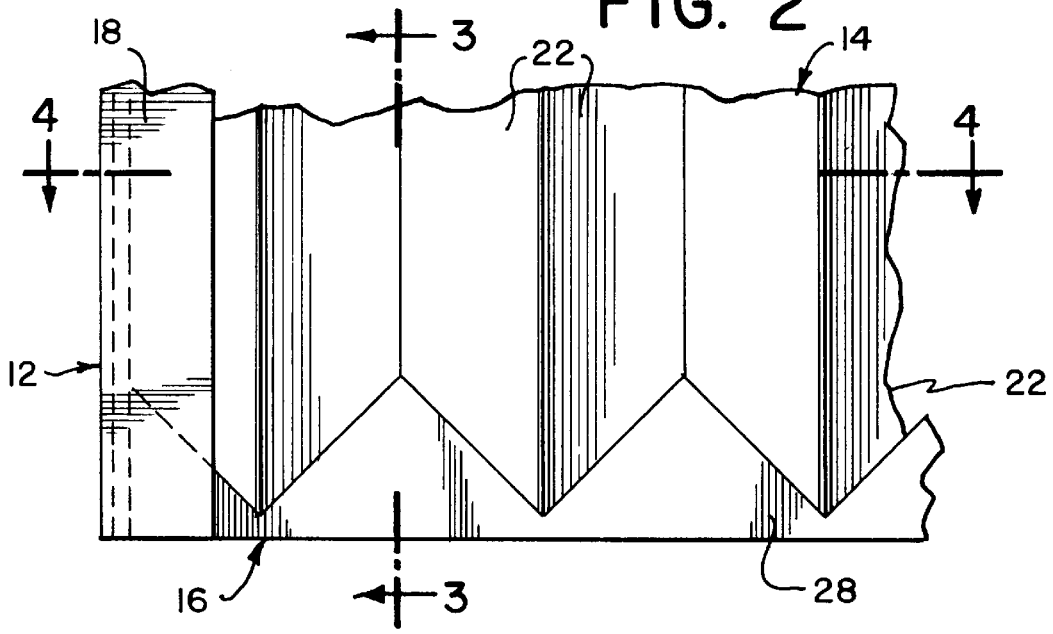
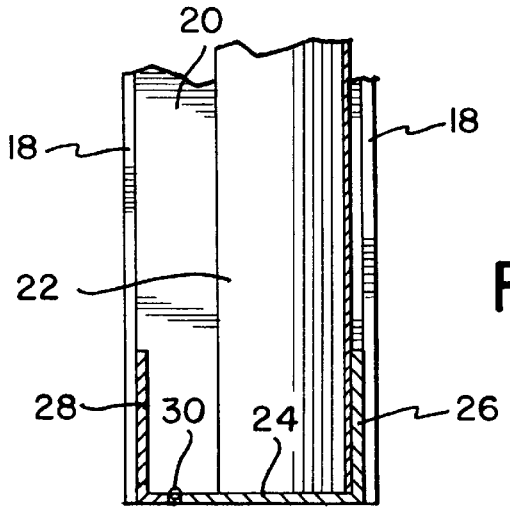
FIG. 3
FIG. 4
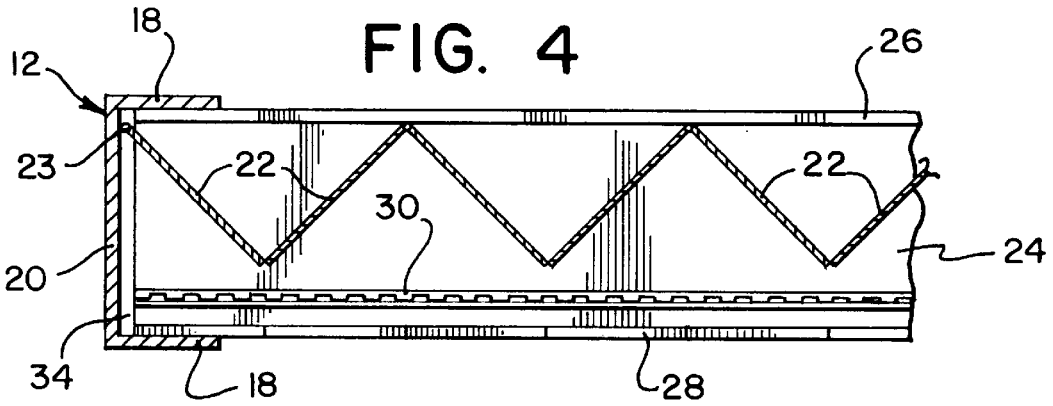

RETRACTABLE WINDOW PROTECTION DEVICE

BACKGROUND OF THE INVENTION

1. Field of the Invention

The present invention relates to protective covers for the windows of a residence or other building. More particularly, the invention relates to such covers that are selectively retractable and extendable to protect the windows from flying objects and debris.

2. Description of the Prior Art

In many parts of the United States, as well as the world, severe storms, such as hurricanes, tornadoes, and the like, are an all-too-frequent occurrence. These storms often bring heavy rains, snow, hail, and the like, as well as extremely strong winds. Many times these winds can approach or even exceed one hundred miles per hour. In such extreme winds, anything of relatively small size that is not tied down will be swept up and accelerated to large velocities by the winds. If one of these flying objects happens to strike against an unprotected window, the window will likely be broken as a result of the impact. Not only will the window need replacing, of even greater concern is that as the storm continues additional objects may enter into the residence through the broken window, damaging valuable property or even endangering the lives of the occupants inside the residence.

Conventional shutters are designed with the primary function of blocking sunlight, and are not typically designed with sufficient strength and stability to resist high winds and withstand severe impacts from flying objects. Those shutters are typically mounted to the building with a pair of standard hinges and may even be forcibly removed from the building during a severe storm. Thus, conventional shutters fall well short of providing sufficient protection for windows in extreme weather conditions.

Accordingly, it will be apparent to those skilled in the art that there continues to be a need for a window cover that is sufficiently strong to resist high winds and to prevent flying objects from impacting against the window to thereby protect the window as well as the contents of the building. In addition, there exists a need for such a cover that is selectively extendable and retractable so that it does not obstruct the view through the window when it is not needed. The present invention addresses these needs and others.

SUMMARY OF THE INVENTION

Briefly, and in general terms, the present invention provides a retractable window protection device that can be extended to cover a window when needed, such as during a severe storm with high winds. The retractable window protection device of the present invention incorporates at least one housing mounted to the building adjacent the window. A shutter assembly is mounted inside the housing and includes plural interconnected panel members that are extendable out of the housing to cover the window. An engagement device is also provided and is displaceable between disengaged and engaged positions. The engagement device includes an engagement surface that complements the configuration of the panel members when extended from the housing. Thus, in the engaged position the engagement surface contacts the respective panel members and locks the members in place.

Thus, the retractable window protection device of the present invention in one preferred embodiment comprises: a housing mounted to a building adjacent the window; a shutter assembly comprising plural pivotally interconnected panel members, the shutter assembly including a first end connected to the housing, the shutter assembly being extendable from the housing to cover at least a portion of the window, and being retractable to be contained within the housing; and an engagement device displaceable between disengaged and engaged positions, the engagement device having an engagement surface shaped to engage the panel members when the panel members are extended from the housing and the engagement device is in the engaged position.

In an alternative embodiment of the present invention, the retractable window protection device includes a pair of the housings, shutters, and engagement devices, with the housings being mounted on either side of the window.

Other features and advantages of the present invention will become apparent from the following detailed description, taken in conjunction with the accompanying drawings which illustrate, by way of example, the features of the present invention.

DESCRIPTION OF THE DRAWINGS

FIG. 2 is a partial front view, in reduced scale, of the retractable window protection device of FIG. 1 with an engagement device in a disengaged position;

FIG. 3 is a cross-sectional side view taken along the line 3—3 of FIG. 2;

FIG. 4 is a top plan view taken along the line 4—4 of FIG. 2;

DETAILED DESCRIPTION OF THE PREFERRED EMBODIMENT

Figure 1:
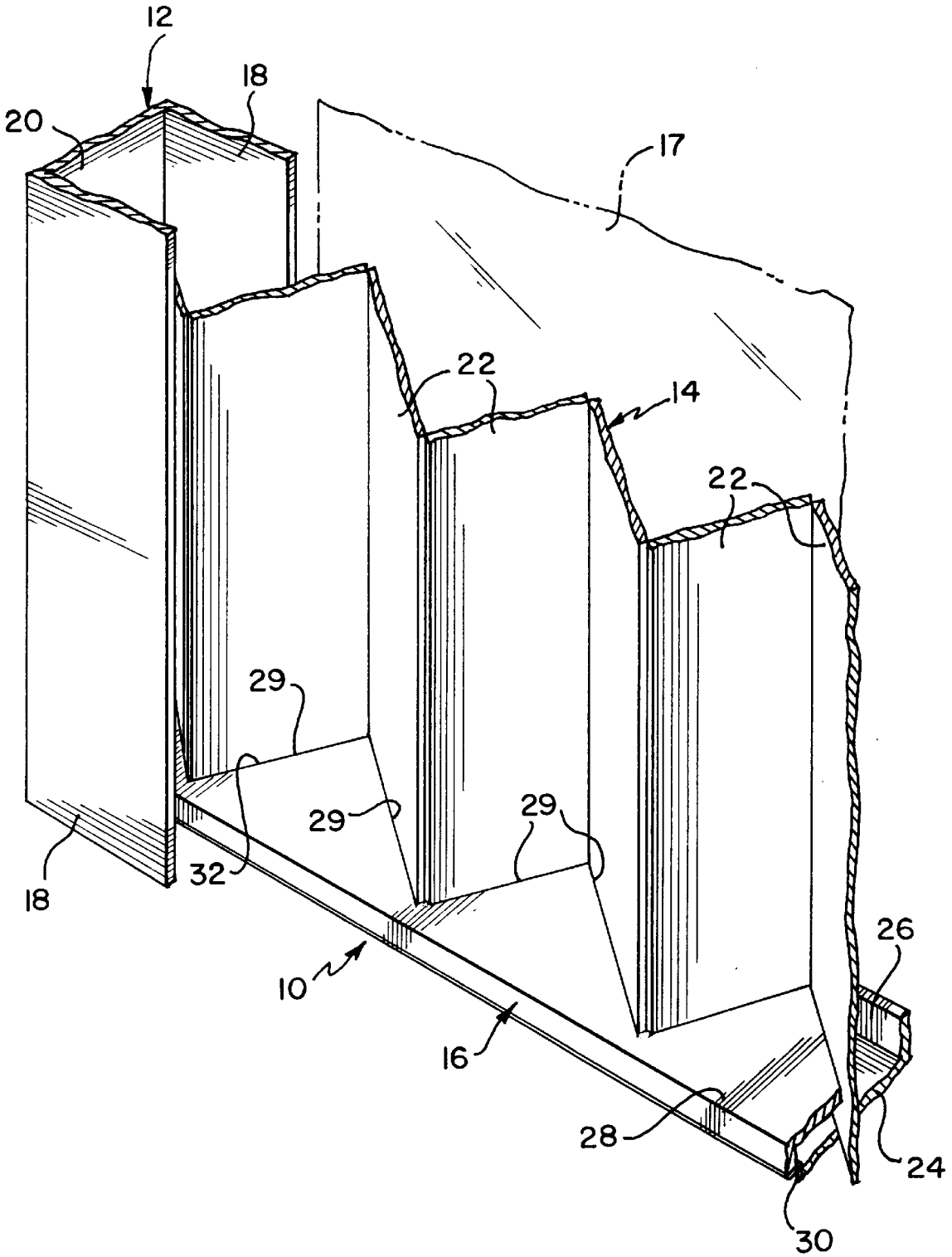
FIG. 1 is a partial perspective view of a retractable window protection device embodying the present invention.
Figure 5:
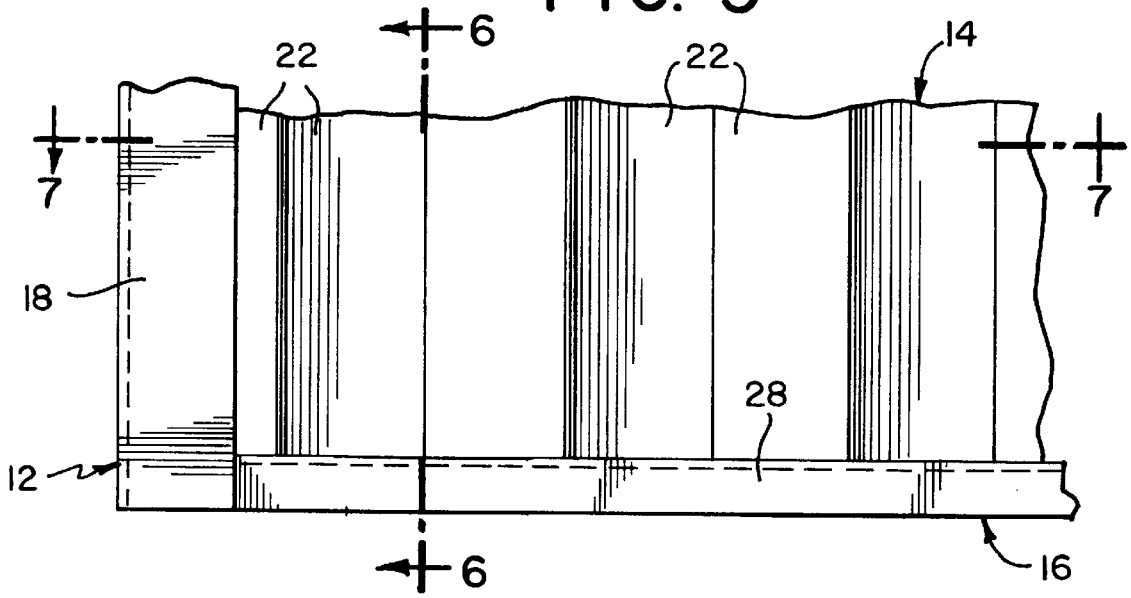
FIG. 5 is a front view similar to FIG. 2 but showing the engagement device in an engaged position.
Figure 6:
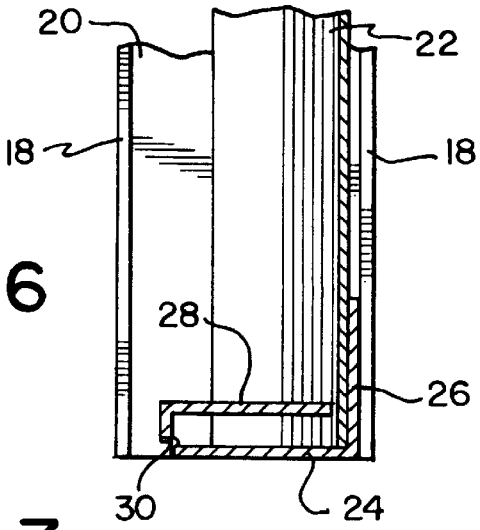
FIG. 6 is a cross-sectional side view taken along the line 6—6 of FIG. 5.

In the following detailed description, like reference numerals will be used to refer to like or corresponding elements in the different figures of the drawings. Referring now to the drawings, and particularly to FIGS. 1, 2 and 5, there is shown, generally, a retractable window protection device 10 comprising a preferred embodiment of the present invention. The retractable window protection device includes, generally, a housing 12, a retractable shutter assembly 14, and an engagement device 16. The shutter assembly is preferably housed within the housing during periods of non-use, and is extendable out from the housing to cover at least a portion of a window 17 (shown in phantom in FIG. 1) as needed. The engagement device may be engaged with the shutter assembly (FIGS. 5 through 7) to lock the shutter assembly in the extended position and thereby provide an effective cover to protect the window.

Referring to FIG. 1, the housing 12 is preferably in the form of an elongated, C-shaped housing including parallel side walls 18 and a back wall 20 perpendicular to the side walls and joining the side walls together. One of the side walls is mounted to a building at a location adjacent the window 17 to be protected, the side wall being securely mounted to the building in any suitable manner, such as with screws, nails, or the like. The housing is oriented such that it opens toward the window. The housing is preferably formed of metal such as a heavy gauge aluminum, but may be made of other materials, such as, for example, hard plastic, wood, or the like.

Figure 7:
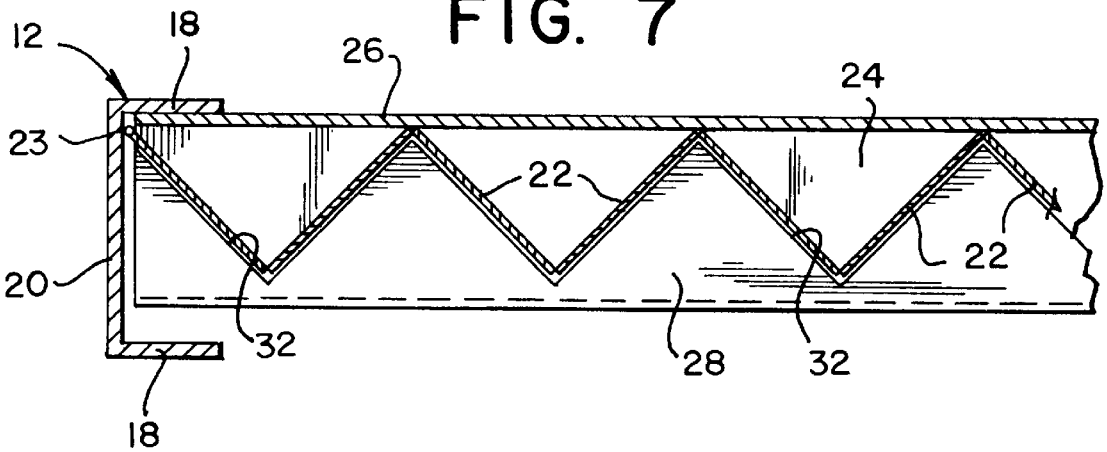
FIG. 7 is a top plan view taken along the line 7—7 of FIG. 5.

Referring to FIGS. 1, 4 and 7, the retractable shutter assembly 14 comprises plural rectangular panel members 22 oriented such that the longitudinal sides extend in a vertical direction. The panels are pivotally interconnected to the adjacent panels along their longitudinal edges by respective hinges (not shown). In one embodiment, the hinges are discrete components that are connected to respective adjacent pairs of panel members to pivotally join the respective panel members together. The panels may alternatively be formed, such as by injection molding techniques, to define living hinges between the respective panel members. The left-most panel member (as shown in FIG. 4) is pivotally connected to the inside surface of the back wall 20 by means of a conventional hinge 23. Thus, the panel members may be retracted into the housing to assume a stacked relationship, and may also be extended from the housing to assume a zig-zag or switchback configuration, as shown in the Figures.

The panel members 22 of the retractable shutter assembly 14 are preferably formed of a metal such as a heavy gauge aluminum. Alternatively, the panel members may be formed of a polymeric material such as a hard plastic and machined to define the living hinges between the respective panel members. It will thus be apparent that the panel members 22 can be formed to be transparent or translucent (i.e., when the panel members are formed of a polymer), or can be opaque (i.e., when the panel members are formed of a metal such as aluminum).

Referring now to FIGS. 1–7, the displaceable engagement device 16 will be described in greater detail. In a preferred embodiment the engagement device comprises a substantially planar base member 24 and an upwardly projecting back wall 26 connected to the base member. The base member defines a track along which the shutter assembly 14 may be extended and retracted as described above. The engagement device further includes an interlock member 28 pivotally connected to the base member at the forward edge of the base member. The pivotal connection is achieved by means of a hinge 30, which preferably takes the form of a conventional elongated hinge connected to the edge of the base member and to the interlock member. Alternatively, the interlock member and base member may be formed by injection molding procedures to define a living hinge therebetween. The interlock member 28 is formed with an engaging surface 32 in the form of plural spaced apart ridges 29 shaped to complement the zig zag configuration of the panel members 22 when extended from the housing 12. The base member and interlock member may be formed of a metal such as heavy gauge aluminum or, alternatively, of a polymer such as hard plastic.

In a preferred embodiment, the base member 24 is pivotally connected to the housing 12 by means of a hinge 34. Thus, the engagement device 16 may be retracted up into the housing to assume a vertical orientation, or may be extended from the housing to assume a horizontal orientation as shown in FIGS. 1 through 7. Alternatively, the engagement device 16 may be mounted directly to the building directly beneath the window 17.

The back wall 26 preferably has a low profile to allow for retraction of the engagement device 16 into the housing 12. The back wall is positioned to contact the rearwardly disposed hinges of the shutter assembly 14 to provide support to the shutter assembly (see FIGS. 4 and 7).

The retractable window protection device 10 further includes a support bracket 36 (see FIGS. 2 and 8) mounted to the building directly beneath the window to be protected. The bracket is preferably fixedly mounted to the building by means of screws 38. The bracket defines a horizontal ledge 40 upon which the bottom surface of the base member 24 rests when in the horizontal position (see FIG. 2).

Figure 8:
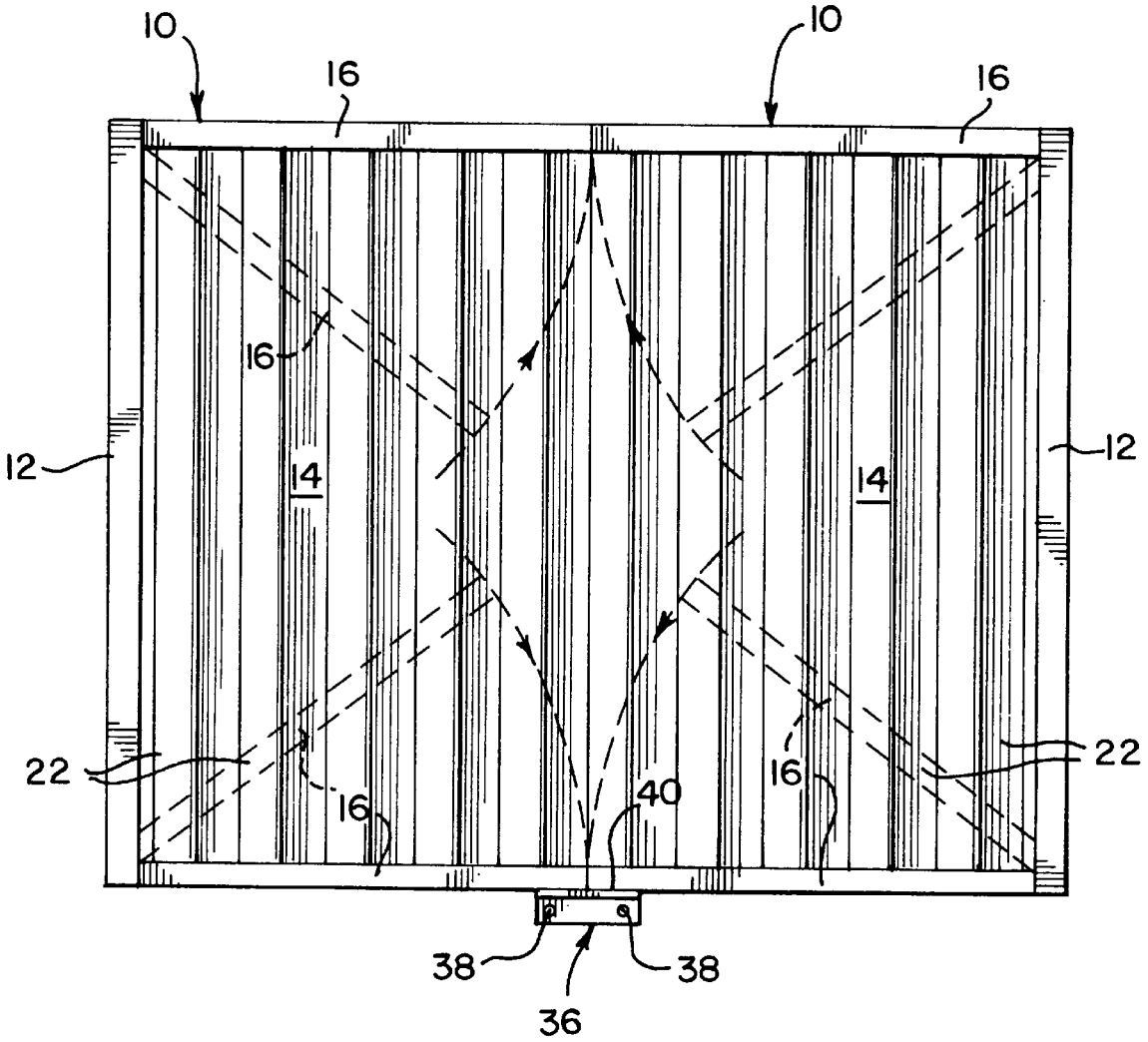
FIG. 8 is a front view showing lower and upper engagement devices being pivoted from a pair of housings and into their respective positions.

As shown in FIG. 8, the window protection device 10, in one preferred embodiment, includes a housing 12, shutter assembly 14, and lower engagement device 16 mounted on either side of the window, as well as a pair of upper engagement devices 16 disposed on either side of the window and engaged to the respective housings 12. The upper engagement devices are preferably formed identically to the lower engagement devices, and, therefore, include the interlock device 28 to engage the panel members 22 adjacent the respective upper ends of the panel members. The upper engagement devices may, alternatively, not include the interlocking device. The upper engagement devices may simply rest on top of the panel members 22, or may be releasably secured to the building in a well known manner.

While the window protection device 10 has been described as being useful in times of severe storms and the like, it will be apparent that the device has utility in many other situations as well. As an example, in areas where children play, the window protection device may be used to prevent balls, rocks, and other objects thrown by the children from breaking the window 17.

In use, a pair of window protection devices 10 are preferably mounted to the building on either side of the window to be protected. When needed, a user pivotally draws the base members 24 from the housings 12 until the base members are horizontal and resting on top of the support bracket 36. The interlock members 28 are then pivoted to the disengaged positions (see FIG. 3). The shutter assemblies 14 are then extended from the respective housings to assume the zig zag configurations. Preferably, the shutter assemblies 14 at least partially overlap each other in the center region. Interlock members 28 are then pivoted back to their respective engaging positions (see FIGS. 6 and 7) to sandwich the panel members between the interlock members 28 and the back walls 26 and, thereby, provide a stable, secure window cover.

Similarly, in a window protection device 10 incorporating the upper engagement devices 16 (see FIG. 8), the upper engagement devices are also pivoted into place and the interlock members 28 pivoted into their respective engaging positions. In such an embodiment, the panel members 22 are locked into place at their lower and upper ends and are supported against flying debris and the like.

From the foregoing, it will be apparent that the retractable window protection device 10 of the present invention provides a reliable, easy-to-use system that protects a window from flying debris during severe weather conditions. In addition, the device may be conveniently stowed away when it is not needed, and thus does not obstruct the view through or otherwise interfere with the window 17.

While a form of the invention has been illustrated and described, it will be apparent to those skilled in the art that various modifications and improvements may be made without departing from the spirit and scope of the invention. For example, device 10 may be used to protect sliding glass doors, window frames in a door or a door itself. As such, it is not intended that the invention be limited, except as by the appended claims.

What is claimed is:

1. A retractable shutter assembly for protecting a window of a building, said shutter assembly comprising:

a housing adapted to be mounted to the building adjacent the window;

a shutter assembly comprising plural pivotally interconnected panel members, the shutter assembly including a first end connected to the housing, the shutter assembly being extendable from the housing to cover at least a portion of the window, and being retractable to be contained within the housing, in a fully extended position the panels of said shutter assembly form a non-planar configuration; and at least one engagement device rotatable about a first axis between a substantially vertical retracted position and a substantially horizontal extended position, said engagement device while in the extended position being rotatable about a second axis, substantially perpendicular to the first axis, between a disengaged position and an engaged position, said engagement device having an engagement surface shaped to complement the non-planar configuration of the panel members when the panel members are fully extended from said housing, said engagement device being displaced to the engaged position to secure the panel members in place when the panel members are fully extended from said housing.

2. The retractable shutter assembly of claim 1, wherein said engagement device is pivotally connected to said housing.

3. The retractable shutter assembly of claim 1, wherein said shutter assembly is formed of metal.

4. The retractable shutter assembly of claim 1, wherein said shutter assembly is formed of hard plastic.

5. The retractable shutter assembly of claim 1, wherein said engagement device comprises:

a base plate; and an interlock member pivotally connected to said base plate, said interlock member being formed with the engagement surface.

6. The retractable shutter assembly of claim 1, wherein said engagement device comprises a pair of engagement devices, one of which engages said shutter assembly adjacent a lower end thereof, and the other of which engages said shutter assembly adjacent an upper end thereof.

7. The retractable shutter assembly of claim 5, wherein said interlock member is pivotally connected to said base plate by a hinge.

8. The retractable shutter assembly of claim 2, further comprising a support bracket mounted to the building to engage a portion of said engagement device when said engagement device is pivoted to the extended position.

9. A retractable shutter assembly for protecting a window of a building, said shutter assembly comprising:

a pair of housings mounted to the building on opposite sides of the window;

a pair of shutter assemblies, each shutter assembly comprising plural pivotally interconnected panel members and including a first end connected to one of the respective housings, each shutter assembly being extendable from the respective housings to cover at least a portion of the window and being retractable to be contained within the respective housings, in a fully extended position the panels of said shutter assemblies form a non-planar configuration; and at least one engagement device rotatable about a first axis between a substantially vertical retracted position and a substantially horizontal extended position, said engagement device while in the extended position being rotatable about a second axis, substantially perpendicular to the first axis, between a disengaged position and an engaged position, said engagement device having an engagement surface shaped to complement the non-planar configuration of the panel members when the panel members are fully extended from said respective housings, said engagement device being displaced to the engaged position to secure the panel members in place when the panel members are fully extended from said housings.

10. The retractable shutter assembly of claim 9, wherein said engagement device comprises a pair of engagement members pivotally connected to said respective housings.

11. The retractable shutter assembly of claim 9, wherein said shutter assemblies are formed of metal.

12. The retractable shutter assembly of claim 9, wherein said shutter assemblies are formed of hard plastic.

13. The retractable shutter assembly of claim 9, wherein said engagement device comprises:

a pair of base plates; and a pair of interlock members pivotally connected to said respective base plates, said interlock members being formed with the engagement surface.

14. The retractable shutter assembly of claim 9, wherein said engagement device comprises a pair of engagement devices, one of which engages said shutter assemblies adjacent a lower end thereof, and the other of which engages said shutter assemblies adjacent an upper end thereof.

15. The retractable shutter assembly of claim 13, wherein said interlock members are pivotally connected to said base plates by respective hinges.

16. The retractable shutter assembly of claim 10, further comprising a support bracket mounted to the building to engage a portion of said engagement device when it is pivoted to the extended position.

* * * * *